US010837233B2

(12) United States Patent
Ruetten et al.

(10) Patent No.: US 10,837,233 B2
(45) Date of Patent: Nov. 17, 2020

(54) CONTROL SYSTEM FOR DRILLING MACHINES

(71) Applicant: Caterpillar Inc., Deerfield, IL (US)

(72) Inventors: Nathan A. Ruetten, Peoria, IL (US); Carl J. Moberg, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 35 days.

(21) Appl. No.: 16/382,948

(22) Filed: Apr. 12, 2019

(65) Prior Publication Data

US 2020/0325729 A1 Oct. 15, 2020

(51) Int. Cl.

*E21B 44/02* (2006.01)
*E21B 19/086* (2006.01)
*E21B 7/02* (2006.01)

(52) U.S. Cl.

CPC ..... *E21B 7/022* (2013.01); *E21B 19/086* (2013.01); *E21B 44/02* (2013.01); *E21B 7/025* (2013.01)

(58) Field of Classification Search

CPC ..... E21B 44/00; E21B 44/06; E21B 19/08; E21B 19/086; E21B 44/02; E21B 7/022; E21B 1/02

See application file for complete search history.

(56) References Cited

U.S. PATENT DOCUMENTS 2,865,603 A * 12/1958 Hudson ..... E21B 1/02 91/50
3,330,531 A * 7/1967 Slator ..... E21B 19/08 415/150
3,659,655 A 5/1972 Gyongyosi
3,903,697 A * 9/1975 Snyder ..... E21B 44/06 60/421
4,246,973 A * 1/1981 Mayer ..... E21B 44/06 173/11
4,458,764 A * 7/1984 Lidstrand ..... E21B 19/086 173/153
4,660,656 A * 4/1987 Warren ..... E21B 44/04 175/26
5,168,937 A * 12/1992 Hamner ..... E21B 19/084 173/4
6,293,359 B1 9/2001 Dobran et al.
7,350,593 B1 4/2008 Brookover
2012/0097449 A1 * 4/2012 Viitaniemi ..... E21B 44/02 175/27

* cited by examiner

*Primary Examiner* — Kipp C Wallace
(74) *Attorney, Agent, or Firm* — Bookoff McAndrews

(57) ABSTRACT

A control system for a drilling machine includes a vertically movable and rotatable drill string having a drill bit at a distal end, a hydraulic cylinder coupled to the drill string to provide a motive force for the vertical movement of the drill string, the hydraulic cylinder having an extend chamber and a retract chamber, a counterbalance valve selectively opening to fluidly couple the retract chamber to a drain, and a holdback valve selectively controlled to adjust the opening of the counterbalance valve based on a weight of the drill string.

20 Claims, 5 Drawing Sheets

CONTROL SYSTEM FOR DRILLING MACHINES

TECHNICAL FIELD

The present disclosure relates generally to drilling machines, and more particularly, to control systems for such drilling machines.

BACKGROUND

Mobile drilling machines, such as blasthole drilling machines, are typically used for drilling blastholes for mining, quarrying, dam construction, and road construction, among other uses. The process of excavating rock, or other material, by blasthole drilling includes using the blasthole drill machine to drill a plurality of holes into the rock and filling the holes with explosives. The explosives are detonated causing the rock to collapse and rubble of the collapse is then removed and the new surface that is formed is reinforced.

Mobile drilling machines may include a hydraulic system to move a hydraulic feed cylinder down and up the drill mast, thereby extending the drill string into the drill hole and retracting the drill string from the drill hole. In doing so, the hydraulic system varies a hydraulic force or pressure to both sides of the hydraulic feed cylinder to maintain the drill string stationary, extend the drill string, and retract the drill string. It is beneficial to maintain consistent settings for the hydraulic force used to extend the drill string into the drill hole. For example, maintaining consistent extend settings helps to provide consistent and desired forces at the drill bit. However, during the drilling process, the drill string will have a varying weight as pipes are added and removed from the drill string. This variable weight requires a change in the hydraulic force or pressure acting on the retract side of the hydraulic feed cylinder. If this change in the hydraulic force on the retracting side of the hydraulic feed cylinder is not controlled properly, it can cause changes in the required pressures on the extend side, resulting in undesired forces on the drill bit. Such undesired forces can lead to inefficient drilling, increased drilling cycle time, and reduced bit life.

U.S. Pat. No. 7,350,593, issued to Brookover on Apr. 1, 2008 ("the '593 patent"), describes an earth drilling rig for maintaining a desired weight on a drill bit. The '593 patent describes a control device to automatically maintain a desired weight on the drill bit by monitoring air pressure and torque of the drill. The control device of the '593 patent may monitor the rate of the penetration of the drill string and regulate the rotation speed of the drill and reduce the effective weight on the drill bit when the pneumatic pressure in the drill bit falls below a predetermined level during drilling. However, the '593 patent does not disclose adjusting the retract forces on the drill string to maintain the force or pressure settings for extending the drill string.

The systems and methods of the present disclosure may address or solve one or more of the problems set forth above and/or other problems in the art. The scope of the current disclosure, however, is defined by the attached claims, and not by the ability to solve any specific problem.

SUMMARY OF THE DISCLOSURE

According to an embodiment, a control system for a drilling machine includes a vertically movable and rotatable drill string having a drill bit at a distal end, a hydraulic cylinder coupled to the drill string to provide a motive force for the vertical movement of the drill string, the hydraulic cylinder having an extend chamber and a retract chamber, a counterbalance valve selectively opening to fluidly couple the retract chamber to a drain, and a holdback valve selectively controlled to adjust the opening of the counterbalance valve based on a weight of the drill string.

According to another embodiment, a control system for a drilling machine includes a vertically movable and rotatable drill string having a drill bit at a distal end, a hydraulic cylinder coupled to the drill string to provide a motive force for the vertical movement of the drill string, the hydraulic cylinder having an extend chamber and a retract chamber, a counterbalance valve selectively opening to fluidly couple the retract chamber to a drain, a holdback valve selectively controlled to adjust a pilot force applied to the counterbalance valve, a position of the holdback valve being adjustable between a fully open position and a fully closed position, and a controller. The controller receives a first set of inputs corresponding to a pressure of hydraulic fluid in the retract chamber, receives a second set of inputs corresponding to a current applied to the holdback valve and corresponding to a position of the holdback valve, and calibrates the holdback valve based at least on the first and second set of inputs, the calibration controlling the drilling machine so that a particular hydraulic pressure applied to the extend chamber provides approximately the same effective weight on the drill bit regardless of the weight of the drill string.

According to yet another embodiment, a method of controlling a drilling machine is provided, the drilling machine including a vertically movable and rotatable drill string having a drill bit at a distal end, a hydraulic cylinder coupled to the drill string to provide a motive force for the vertical movement of the drill string, the hydraulic cylinder having an extend chamber and a retract chamber, a counterbalance valve selectively opening to fluidly couple the retract chamber to a drain; a holdback valve selectively controlled to adjust a pilot force applied to the counterbalance valve, a position of the holdback valve being adjustable between a fully open position and a fully closed position, and a controller. The method includes receiving at the controller, a first set of inputs corresponding to a pressure of hydraulic fluid in the retract chamber, receiving at the controller a second set of inputs corresponding to a current applied to the holdback valve and corresponding to a position of the holdback valve, calibrating the holdback valve based at least on the first and second set of inputs, and controlling the drilling machine based on the calibration so that a particular hydraulic pressure applied to the extend chamber provides approximately the same effective weight on the drill bit regardless of the weight of the drill string.

BRIEF DESCRIPTION OF THE DRAWINGS

The accompanying drawings, which are incorporated in and constitute a part of this specification, illustrate various exemplary embodiments and together with the description, serve to explain the principles of the disclosure.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Further, relative terms, such as, for example, "about," "substantially," "generally," and "approximately" are used herein to indicate a possible variation of ±10% in the stated value.

Figure 1:
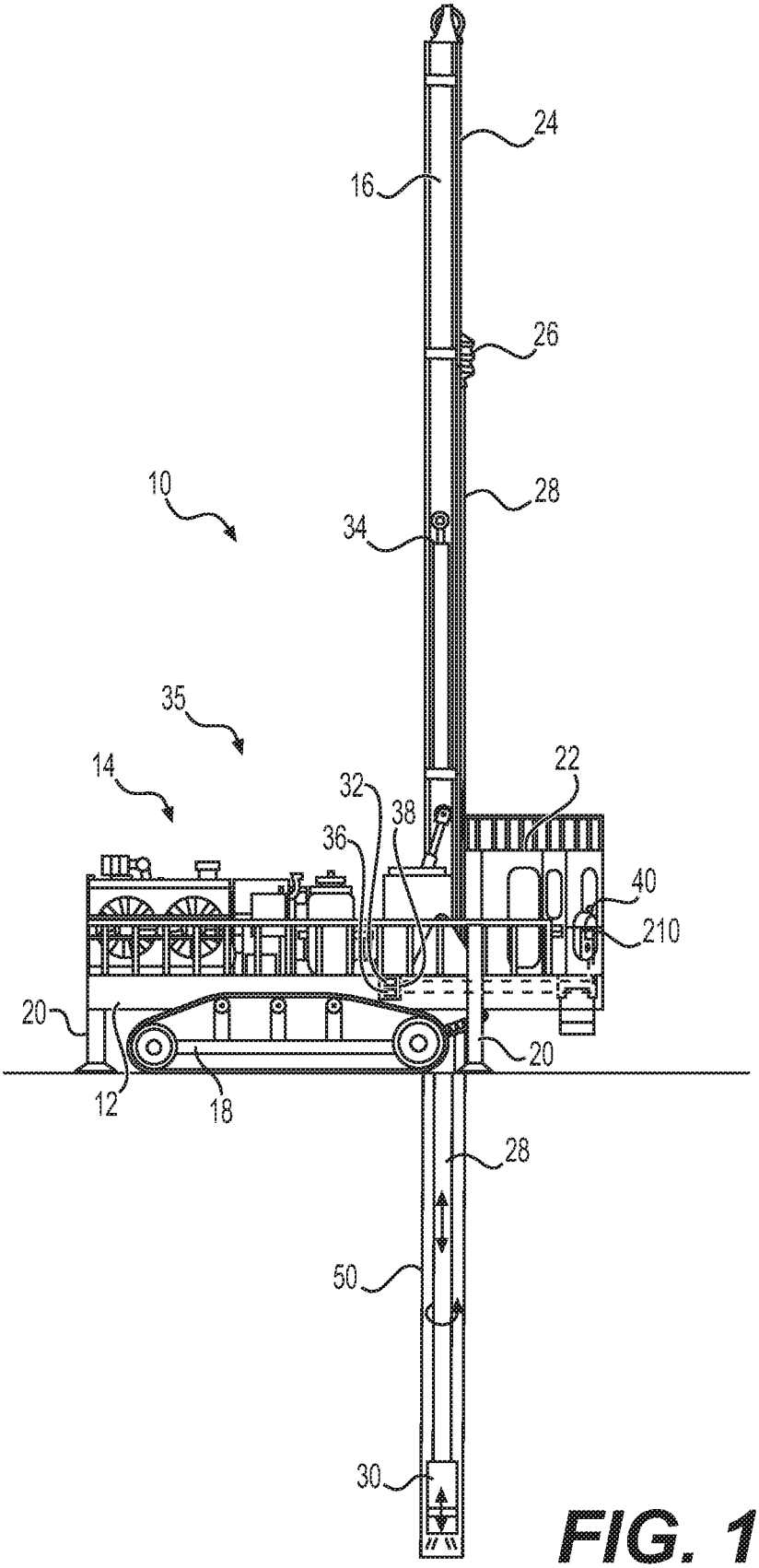
FIG. 1 illustrates a schematic side view of a drilling machine with an exemplary control system, according to aspects of the disclosure.

FIG. 1 illustrates a schematic side view of an exemplary drilling machine 10. The disclosure herein may be applicable to any type of drilling machine, however, reference will be made below particularly to a mobile drilling machine. As shown in FIG. 1, mobile drilling machine 10 may include a frame 12, machinery 14, and a drilling mast 16. Frame 12 may be supported on a ground surface by a transport mechanism, such as crawler tracks 18. Crawler tracks 18 may allow mobile drilling machine 10 to maneuver about the ground surface to a desired location for a drilling operation. Frame 12 may further include one or more jacks 20 for supporting and leveling mobile drilling machine 10 on the ground surface during the drilling operation. Frame 12 may support the machinery 14, which may include engines, motors, batteries, pumps, air compressors, a hydraulic fluid storage tank 38 (shown schematically in FIG. 1) and/or any other equipment necessary to power and operate mobile drilling machine 10. Frame 12 may further support an operator cab 22, from which a user, or operator, may maneuver and control mobile drilling machine 10 via user interfaces and displays 40. Mobile drilling machine 10 may further include a controller 210 for controlling aspects of mobile drilling machine 10.

As further shown in FIG. 1, drilling mast 16 may include a mast frame 24 which may support a drill motor assembly, or rotary head 26, movably mounted on the mast frame 24. Rotary head 26 may couple to, and may be controllable to rotate, a drill string 28 of drilling pipe segments on which a drill bit 30 (e.g., down-the-hole hammer-type drill bit) may be mounted for drilling into the ground surface. Rotary head 26 may be any type of rotary head, such as a hydraulic rotary head or the like. Rotary head 26 may further include one or more hydraulic fluid lines (not shown) for conveying hydraulic fluid. It is understood that the hydraulic lines could alternatively be pneumatic lines, and/or additional pneumatic lines could be included at the rotary head 26, for example to be supplied to the drill bit 30 for various drilling functions. The hydraulic fluid may be used to rotate a shaft of rotary head 26 on which the drill string 28 is connected, for rotating the drill string 28 (and drill bit 30). The hydraulic lines of rotary head 26 may be coupled to one or more hydraulic valves 32 (shown schematically in FIG. 1) for controlling the amount, and flow rate, of the hydraulic fluid to and from rotary head 26. In the exemplary embodiment, hydraulic valve(s) 32 may be associated with a hydraulic motive system 35 including, for example, a hydraulic pump 37 (FIG. 2) and hydraulic fluid storage tank 38.

Drilling mast 16 may further include a hydraulic feed cylinder 34 (located within mast frame 24) connected to rotary head 26 via a cable and pulley system (not shown) for vertically moving rotary head 26 (and drill string 28) up and down along the mast frame 24. As such, when hydraulic feed cylinder 34 is extended, hydraulic feed cylinder 34 may exert a motive force on rotary head 26 for extending (e.g., pulling-down) rotary head 26 along mast frame 24 and toward drill hole 50. Likewise, when hydraulic feed cylinder 34 is retracted, hydraulic feed cylinder 34 may exert a motive force on rotary head 26 for retracting or hoisting up rotary head 26 along mast frame 24 away from drill hole 50. Thus, hydraulic feed cylinder 34 may be controllable to control rotary head 26 to move up and down the mast frame 24 such that drill bit 30 on drill string 28 may be urged down towards, and into, the drill hole 50, or hoisted up from the drill hole 50. As used herein, the term "feed" in the context of the feed cylinder 34 includes movement of the drill string 28 in either direction (up or down). Hydraulic feed cylinder 34 may also include hydraulic lines (not shown) for receiving and conveying hydraulic fluid to and from the feed cylinder 34. The hydraulic motive fluid for feed cylinder 34 may be pressurized by hydraulic pump 37 from fluid storage tank 38. Control of the flow of hydraulic fluid to and from feed cylinder 34 will be described in connection with the control system 100 of FIG. 2. It is understood that the hydraulic fluid of hydraulic motive system 35 may be any type of hydraulic fluid, such as hydraulic oil or the like.

Figure 2:
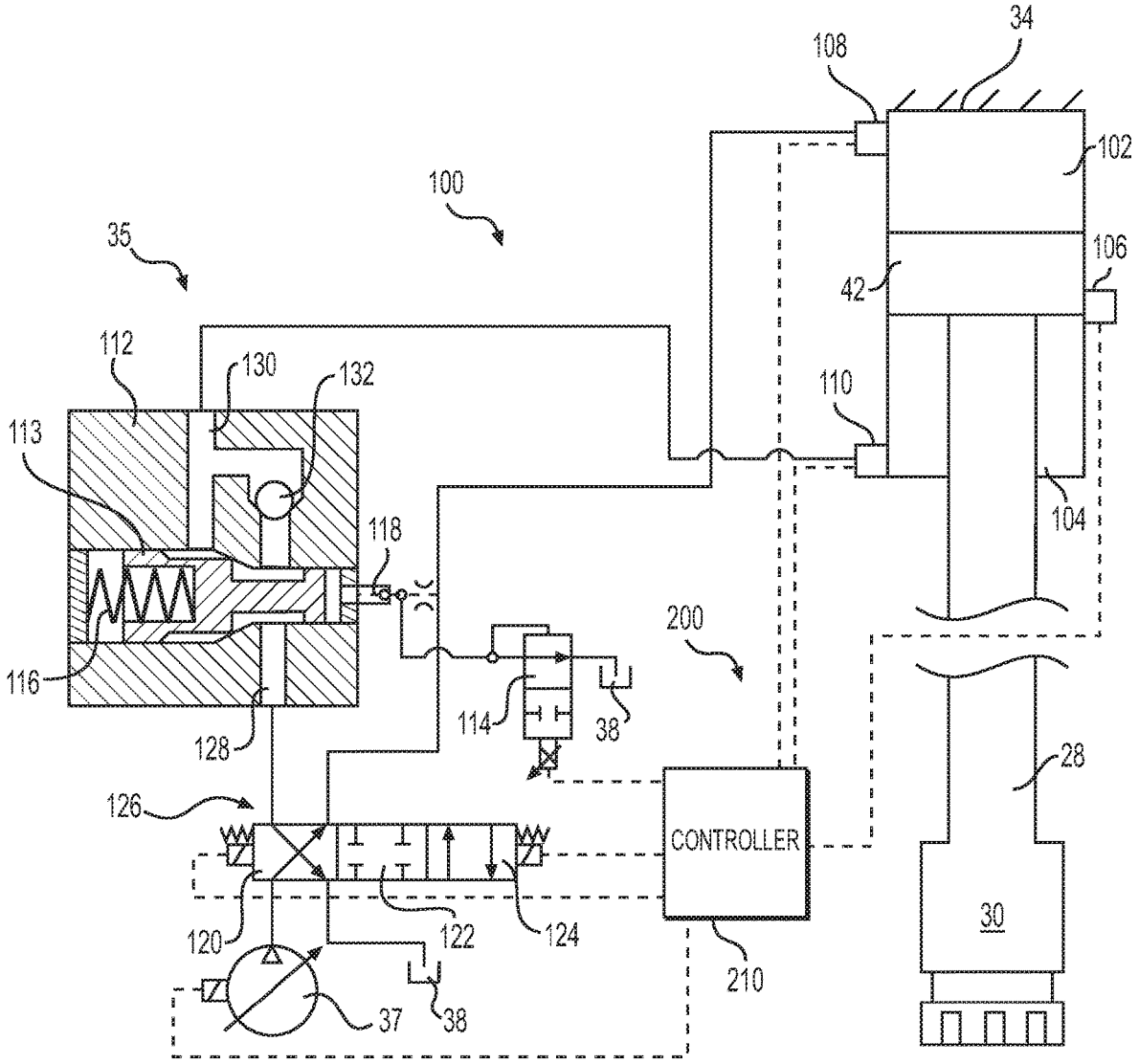
FIG. 2 illustrates a schematic view of the exemplary control system of FIG. 1.

FIG. 2 illustrates a schematic view of a drill string extend/retract control system 100 of the drilling machine 10 of FIG. 1. Control system 100 includes the hydraulic motive system 35, electronic control system 200, and feed cylinder 34 for controlling the movement of the rotary head 26 and drill string 28 in an extended (downward) direction, and a retracted (upward) direction. For ease of explanation, the rotary head 26, drill string 28, and drill bit 30 will collectively be referred to as drill string 28 unless stated otherwise. Further, the depiction of the hydraulic feed cylinder 34 is simplified in FIG. 2 from the pulley arrangement discussed above in FIG. 1 to show a fixed cylinder end and a rod end directly connected to the rotary drill string 28. It is understood that the hydraulic feed cylinder 34 could be connected to drill string 28 in any other appropriate manner. Hydraulic feed cylinder 34 may include a piston 42, an extend chamber 102 on a first side of piston 42 for urging drill string downward, and a retract chamber 104 on a second, opposite side of piston 42 for urging drill string 28 upward.

The controller 210 of electronic control system 200 is connected to a first pressure sensor 108 that measures a pressure of the hydraulic fluid in the extend chamber 102, a second pressure sensor 110 that measures a pressure of the hydraulic fluid in the retract chamber 104, and a position sensor 106 to measure a position of piston 42. Controller 210 also sends signals to control valve 126 to shift the valve to connect or block the feed cylinder 34 to the hydraulic pump 37 and the hydraulic fluid storage tank 38. Controller 210 may also connect to hydraulic pump 37 to vary the displacement thereof, and connect to a holdback valve 114 as will be discussed below.

With continued reference to FIG. 2, a counterbalance valve 112 and the holdback valve 114 operate to provide the appropriate amount of hydraulic fluid in each of extend chamber 102 and retract chamber 104. As will be described in detail herein, holdback valve 114 can be calibrated to adjust the opening of the counterbalance valve 112 based on a weight of the drill string 28, such that a particular pressure of the hydraulic fluid in extend chamber 102 causes the same forces on drill string 20 and bit 30 (effective weight on bit 30), regardless of the weight of drill string 28.

As hydraulic fluid is added to extend chamber 102 and removed from retract chamber 104, drill string 28 moves downwards in an extend direction. Conversely, when fluid is added to retract chamber 104 and removed from extend chamber 102, drill string 28 moves in an upwards (e.g., hoist or retract) direction.

Position sensor 106 measures a displacement of piston 42 and transmits this information to controller 210. Position information and pressure information from pressure sensors 108 and 110 can be used in many ways, including to determine a holdback valve calibration value as described below. It is understood that the sensors 108, 110, and 106 could be located at any appropriate location within control system 110 to provide data indicative of the pressures in feed cylinder 34 and vertical movement of drill string 28. For example, position sensor 106 may be a pull string based encoder associated with vertically movable component, or an angular position encoder associated with a sheave or pulley of the system, or any other position sensor.

As shown in FIG. 2, counterbalance valve 112 includes a first passage 128, a second passage 130, a one-way valve passage 132, a valve element 113 connecting the passages 128, 130, and 132. A counterbalance spring 116 and a pilot 118 are located at opposite ends of the valve element 113. Counterbalance spring 116 moves valve element 113 to an open position when a pressure of hydraulic fluid in retract chamber 104 is greater than the force of counterbalance spring 116. Similarly, stop valve 132 opens when the pressure of hydraulic fluid in first passage 128 is greater than a pressure of hydraulic fluid in retract chamber 104. Likewise, when a pressure of hydraulic fluid in retract chamber 104 is greater than a pressure of hydraulic fluid in first passage 128, the stop valve in passage 132 closes. While not shown in the drawings, counterbalance spring 116 may be a mechanically tunable spring set by a user.

Accordingly, counterbalance spring 116 and pilot 118 are configured to cooperate to selectively open counterbalance valve 112 to fluidly couple retract chamber to drain 28, and thus control the pressure in retract chamber 104. Pilot 118 is controlled by holdback valve 114 and a pilot pressure of hydraulic fluid is drawn from the hydraulic line connected to extend chamber 102. As will be described herein, counterbalance valve 112 opens as a function of the pressure in extend and retract chambers 102, 104, and a setting of holdback valve 114.

With continued reference to FIG. 2, control valve 126 is a servo-valve or the like, and is attached to and controlled by controller 210. The flow of hydraulic fluid from hydraulic pump 37 is controlled by moving control valve 126. For example, control valve 126 may move between an extend position 120, a blocking position 122, and a retract position 124. In the extend position 120, the outlet of hydraulic pump 37 is connected to provide pressurized fluid to extend chamber 102. Extend position 120 also connects first passage 128 of counterbalance valve 112 to a drain (i.e., hydraulic fluid storage tank 38), which allows fluid from retract chamber 104 to drain into hydraulic fluid storage tank 38 under certain conditions (when the counter balance valve 112 opens). Control valve 126 also moves to a blocking position 122, which blocks the hydraulic pump 37 from connecting with fuel cylinder 34, and blocks a connection through control valve 126 to storage tank 38. So long as the weight of drill string 28 is not increased, the blocking position 122 of control valve 126 maintains a position of drill string 28 since hydraulic fluid is neither added nor removed from system 100 feed cylinder 34.

Control valve 126 further includes a retract position 124. Retract position 124 connects first passage 128 of counterbalance valve 112 to the output side of hydraulic pump 37, thereby allowing pressurized hydraulic fluid to be supplied to first passage 128. Retract position 124 also connects extend chamber 102 to the hydraulic fluid storage tank 38, and thus allows hydraulic fluid to drain from extend chamber 102 into hydraulic fluid storage tank 38. While control valve 126 is a servo valve, control valve 126 may be any valve or actuator that provides the above-described connections with hydraulic pump 37 and hydraulic fluid storage tank 38.

Holdback valve 114 is also a servo-valve or the like, and is attached to and controlled by controller 210. Holdback valve 114 is a variably adjustable valve, and is shown in a default, open position in FIG. 2. Controller 210 may provide an output signal to change a position of holdback valve 114 from a fully open position to a fully closed position, and any partially open position therebetween. For example, when no current (i.e., 0 Amps current) is applied to holdback valve 114, holdback valve is completely open. Likewise, when a closing current (e.g., when holdback valve 114 is saturated with current) is applied to hold holdback valve 114, holdback valve 114 is in a completely closed position. A position of holdback valve 114 between fully closed and fully open is controlled by varying the current applied to holdback valve 114.

As shown in FIG. 2, holdback valve 114 is connected to drain (i.e., hydraulic fluid storage tank 38) and pilot 118 of counterbalance valve 112 (pilot pressure based on the pressure in extend chamber 102). In the default, open position of holdback valve 114, hydraulic fluid does not build up in pilot 118, but rather passes through holdback valve 114 to hydraulic fluid storage tank 38. This setting provides maximum counterbalance force at counterbalance valve 112 because there is no hydraulic pressure applied by pilot 118. Thus, pilot 118 does not provide any assistance in overcoming the force of spring 116 when holdback valve 114 is fully open. In contrast, when holdback valve 114 is in a completely closed position, hydraulic fluid cannot pass from pilot 118 to hydraulic fluid storage tank 38. The hydraulic fluid builds up at pilot 118 and may provide a force to assist in overcoming the force of spring 116, regardless of the pressure of the hydraulic fluid in second passage 130. Pilot 118 may be configured to provide, for example, less than the full force necessary to overcome the force of spring 116, even when holdback valve 114 is completely closed, and thus at least some hydraulic fluid pressure in second passage 130 is necessary to overcome the force of spring 116 to open counterbalance valve 114. While holdback valve 114 is described as a servo valve, holdback valve 114 may be any valve or actuator that variably opens and closes the connection between pilot 118 and hydraulic fluid storage tank 38. Further, while certain electrical current values are described herein as moving holdback valve 114, these current values are not limiting. It will be understood that any current values may be applied to holdback valve 114, provided that the applied current opens or closes holdback valve 114 as desired. Moreover, while the described embodiment describes the maximum applied current closes holdback valve 114, it will be understood that the maximum current may alternatively completely open holdback valve 114, and a 0 Amp current may fully close holdback valve 114. The correlation of the current to the amount holdback valve 114 is open or closed may be a linear or non-liner relationship.

The relationship between current and holdback pressure may be inconsistent from machine to machine, or even within the same machine over time, due to, e.g., tolerances and/or wear on parts associated with mobile drilling machines. Therefore, a calibration of the system may be desired, as will be described in detail herein.

Figure 3:
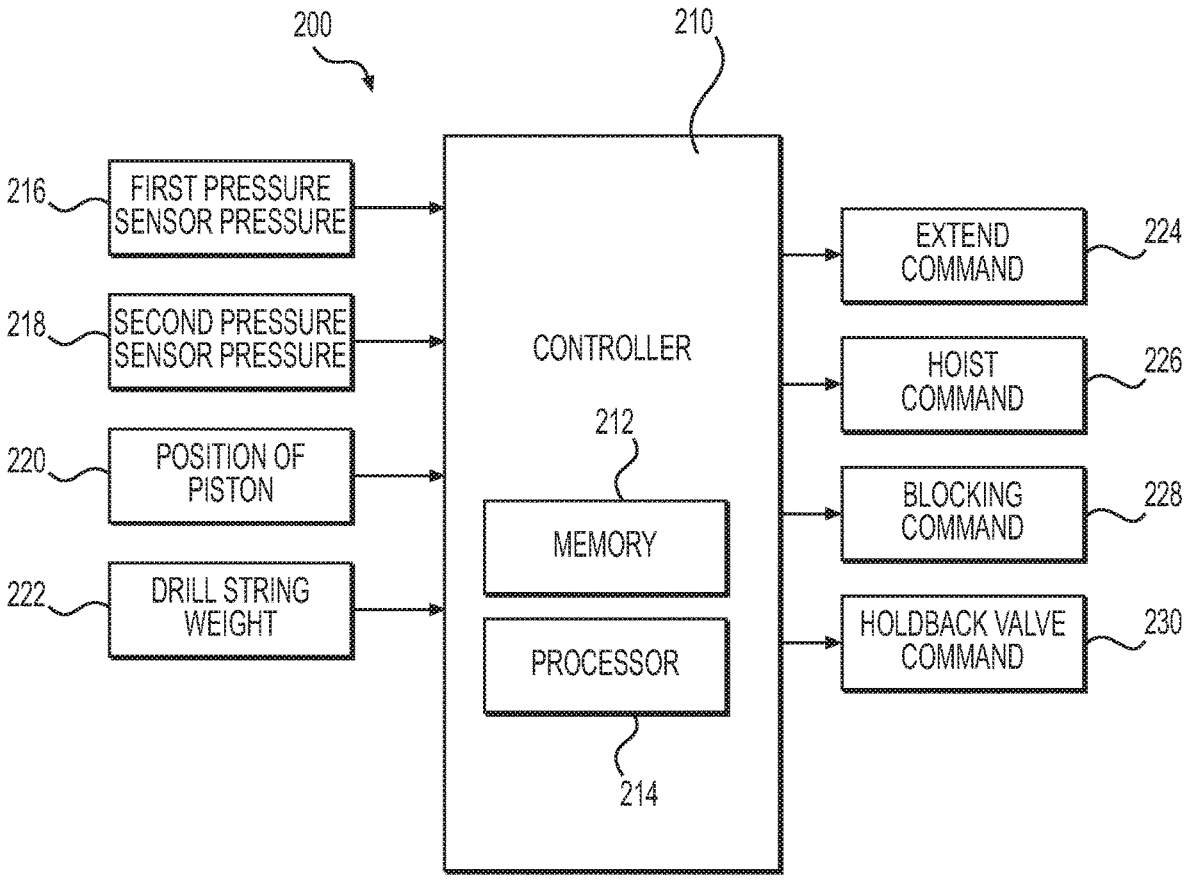
FIG. 3 illustrates a schematic view of the controller of the exemplary control system of FIG. 1.

Referring to FIG. 3, controller 210 may include a memory 212, a processor 214, inputs 216-222, and outputs 224-230. The inputs may include first pressure sensor information 216, second pressure sensor information 218, piston position sensor information 220, and drill string weight 222. Such sensors, operational input, or stored inputs may be obtained using any conventional system (sensors, user inputs, etc.). Outputs include, for example, extend command 224, hoist or retract command 226, blocking command 228, and holdback valve command 230. First pressure sensor information 216, second pressure sensor information 218, and piston position sensor information 220 are received from first pressure sensor 108, second pressure sensor 110, and position sensor 106, respectively, and provide a pressure of hydraulic fluid in each of extend chamber 102 and retract chamber 104, and the position of piston 42.

Controller 210 may embody a single microprocessor or multiple microprocessors that may include means for monitoring operation of the drilling machine 10 and issuing instructions to components of machine 10. For example, controller 210 may include a secondary storage device, and processor 214 may be a central processing unit or any other means for accomplishing a task consistent with the present disclosure. Memory 212 or secondary storage device associated with controller 210 may store data and/or software routines that may assist controller 210 in performing its functions. Further, memory 212 or secondary storage device associated with controller 210 may also store data received from the various inputs associated with mobile drilling machine 10. For example, memory 212 may include a non-volatile memory, but is not limited thereto. The non-volatile may be configured to make the stored data available after the machine is turned off and on again. Numerous commercially available microprocessors can be configured to perform the functions of controller 210. It should be appreciated that controller 210 could readily embody a general machine controller capable of controlling numerous other machine functions. Various other known circuits may be associated with controller 210, including signal-conditioning circuitry, communication circuitry, hydraulic or other actuation circuitry, and other appropriate circuitry.

With continued reference to FIG. 3, drill string weight 222 may include a total weight of the drill string 28, and may be input manually or determined automatically by the control system 100. For example, the drill string weight 222 may be provided directly by providing a total weight value, or by a user input of the type, number, and/or size of the pipes, pipe connectors, drill bit, and/or other components attached to drill string 28. The user input may be received from user interface 40 (FIG. 1), such as a keypad, touch screen, or the like. According to an example, these inputs may be stored to a non-volatile memory such as, e.g., memory 212, and may be available after a power off. The weight of the rotary head assembly may be input by a user or may be pre-loaded and stored in the memory of controller 210. The weight of the drill pipes currently on the drill string may be determined automatically or based on a user input of the number of pipes currently on the drill string. According to one aspect of the present disclosure, to determine the weight of the drill pipes currently on the drill string 28, controller 210 may multiply the number of pipes with the known weight of a single pipe. The weight of the drill bit assembly 30 may be determined by a user input or may be pre-loaded in memory 212 of controller 210.

Extend command 224, hoist command 226, and blocking command 228 are commands transmitted to control valve 126. These commands control the position of control valve 126. For example, extend command 224 controls control valve 126 to move to the extend position 120, blocking command 228 controls control valve 126 to move to the blocking position 122, and hoist command 224 controls control valve 126 to move to the retract position 124. Further, holdback valve command 230 controls the amount of current applied to holdback valve 114, thereby controlling the degree to which holdback valve 114 is open or closed. Controller 210 outputs these commands based on the desired operation of drilling machine 10, as a function of, for example, the pressure and position information received from the associated sensors, as discussed in greater detail herein.

An operation of hydraulic feed cylinder 34 will now be discussed with reference to FIGS. 1 and 2. Hydraulic feed cylinder 34 may be controllable to move piston 42, thereby moving rotary drill string 28 in an extend (e.g., down) direction and a retract (e.g., hoist) direction. For example, in an extend operation, hydraulic fluid is added to extend chamber 102 and hydraulic fluid is removed from retract chamber 104 such that the pressure in retract chamber 104 is less than the combined pressure in the extend chamber 102 and the pressure exerted by drill string 28 on the fluid in retract chamber 104. Likewise, to raise or hoist drill string 28, hydraulic fluid is added to retract chamber 104 and/or removed from extend chamber 102 such that the pressure in retract chamber 104 is greater than the combined pressure in extend chamber 102 and the weight of drill string 28 on the hydraulic fluid in retract chamber 104.

With reference to FIG. 2, continued operation of hydraulic feed cylinder 34 will be described. At the outset, drilling machine pressure control system 100 will be set in a maintain position orientation, such that control valve 126 is set in blocking position 122, where flow of hydraulic fluid from hydraulic pump 37 and to hydraulic fluid storage tank 38 is blocked. In this orientation, hydraulic fluid is unable to pass to or from extend chamber 102 and/or retract chamber 104 through control valve 126. In this orientation, holdback valve 114 will be closed, not allowing pilot 118 to drain to storage tank 38. Thus, the vertical position of the drill string 28 will remain unchanged. For example, if drill string 28 is extended into rock or mud or the like, drill string 28 will maintain this position. Likewise, if drill string 28 is in a raised position, the raise position of drill string 28 will also be maintained.

In the event a user would like to extend drill string 28, controller 210 issues extend command 224. According to an embodiment, when an extend command is input to controller 210, first pressure sensor 108 and second pressure sensor 110 measure the hydraulic fluid pressure and input first pressure sensor pressure 216 and second pressure sensor pressure 218, respectively, to controller 210. The pressure of each of extend chamber 102 and retract chamber 104 may be continuously monitored and updated, or the pressure of each chamber may be measured based on a request to move drill string 28. As discussed herein, extending the drill string 28 requires the combined pressure of the hydraulic fluid in extend chamber 102 and the pressure exerted by drill string 28 on the hydraulic fluid in retract chamber 104 to be greater than the pressure of the hydraulic fluid in retract chamber 104. Accordingly, to extend drill string 28, controller 210 issues extend command 226 to control valve 126 to move to the extend position 120.

With continued reference to FIG. 2, extend position 120 of control valve 126 allows hydraulic fluid to be pumped from hydraulic pump 37 to extend chamber 102. For example, depending on the distance a user wants to extend drill string 28, controller 210 outputs extend command 224 to control valve 126 until the hydraulic fluid in extend chamber 102 reaches a certain or known pressure for the desired extend distance of drill string 28, measured by pressure sensor 108. It is understood that a pump pressure command may be supplied to hydraulic pump 37 for controller 210 to assist in reaching the desired pressure in extend chamber 102. The known pressure may be saved in memory 214 and/or may be input to control panel 40 (see FIG. 1). Once drill string 28 has moved the desired distance, controller 210 outputs blocking command 228 to move control valve 126 to blocking position 122 and maintain the desired extension position.

In the event a user would like to raise or hoist drill string 28, a hoist command 226 may be issued from controller 210 to move control valve 126 to the hoist position 124. According to an embodiment, when a command to hoist drill string 28 is input to controller 210, a pressure of the hydraulic fluid in each of extend chamber 108 and retract chamber 110 is determined. The pressure of each chamber may be continuously monitored and updated, or the pressure of each chamber may be measured based on a request to move drill string 28. As discussed herein, hoisting drill string 28 requires the combined pressure of the hydraulic fluid in extend chamber 102 and the pressure exerted by drill string 28 on the hydraulic fluid in retract chamber 104 to be less than the pressure of the hydraulic fluid in retract chamber 104.

Hoist position 124 of control valve 126 allows pressurized hydraulic fluid to be supplied from hydraulic pump 37 to retract chamber 104 via counterbalance valve 112. Simultaneously, hydraulic fluid is capable of draining from extend chamber 102. Once the combined pressure of the hydraulic fluid in extend chamber 102 and the pressure exerted by drill string 28 on the hydraulic fluid in retract chamber 104 is less than the pressure of the hydraulic fluid in retract chamber 104, drill string 28 is hoisted. As with the extend function, drill string 28 is moved a desired distance in the hoist direction based on a user input or an automated function. For example, depending on the distance a user wants to hoist drill string 28, controller 210 outputs hoist command 226 until the hydraulic fluid in retract chamber 104 reaches a certain or known position for the desired hoist distance of drill string 28, measured by position sensor 106. As noted above a pump pressure command may be provided to hydraulic pump 37 from controller 210 to assist in reaching the desired pressure in retract chamber 104. Again, the known pressure may be saved in memory 214 and/or may be input to user interface 40 (see FIGS. 1 and 3). Once drill string 28 has moved the desired distance, controller 210 outputs blocking command 228 to move control valve 126 to blocking position 122 and maintain the desired retracted position.

During hoisting, pressured hydraulic fluid from hydraulic pump 37 flows through counterbalance valve 112 to extend chamber 104. In particular the pressurized hydraulic fluid flows through first passage 128, through a stop valve 132, into second passage 130, and into retract chamber 104. As described herein, first pressure sensor 108 and second pressure sensor 110 may periodically or continuously monitor the pressure of hydraulic fluid in extend chamber 102 and retract chamber 104. In response to the pressure of hydraulic fluid in retract chamber 104 and/or in extend chamber 102 being appropriate to maintain a desired hoist position of drill string 28, and piston position inputs 220 from position sensor 106, controller 210 sends a blocking command 228 to control valve 126 to move from hoist position 124 to the blocking position 122, thereby maintaining the position of drill string 28. Accordingly, a drilling program and/or a user may cause controller 210 to move control valve 126 between extend position 120, blocking position 122, and hoist position 124 to control a position/height of drill string 28.

As described herein, extending and hoisting drill string 28 depends, in part, on the weight of drill string 28 and the force drill string 28 exerts on the hydraulic fluid in retract chamber 104. For example, as pipes are added and/or removed from drill string 28, the weight of drill string 28 changes, thereby changing the pressures necessary to hold stationary, extend, and/or hoist drill string 28. Thus, there is a need for a calibration of the control system 100, and in particular the holdback valve 114 such that drill string 28 provides a consistent drill string force. For example, calibration of holdback valve 114 allows for a same hydraulic fluid pressure applied to extend chamber 102 to provide the same drill string force, regardless of the weight of drill string 28.

Referring to FIG. 2, holdback valve 114 is adjusted to compensate for a change in weight of drill string 28. The calibration value is determined such that a current is applied to holdback valve 114 to variably adjust the position of holdback valve 114 based on the amount of weight added to drill string 28. As discussed herein, holdback valve 114 is in a default fully open position in FIG. 2—corresponding to no current (i.e., 0 Amps) applied to holdback valve 114. When holdback valve 114 is in the default open position, hydraulic fluid does not build up between pilot 118 and holdback valve 114. This setting provides maximum counterbalance force at counterbalance valve 112 because there is no hydraulic pressure applied to pilot 118. Thus, pilot 118 does not provide any assistance in overcoming the force of spring 116 when holdback valve 114 is fully open, and hydraulic fluid drains from retract chamber 104 only when the pressure of the hydraulic fluid in second passage 130 applied against the counterbalance valve element 113 is greater than the force of spring 116. Accordingly, providing hydraulic fluid to extend chamber 102 (during the extend position 120 of control valve 126) when holdback valve 114 is fully open will provide a control of the pressure in retract chamber 104 solely based on the pressure in second passage 130 of counterbalance valve 112 acting against valve element 113 (corresponding to the pressure in retract chamber 104).

On the other hand, when the weight of drill string 28 increases, e.g., by adding pipes or a different drill bit 30, the same hydraulic fluid pressure provided to extend chamber 102 may result in a different effective weight on bit 30. To avoid this variability, holdback valve 114 can be calibrated to variably adjust to compensate for changes in the weight on the drill string 28 and, thus, ensure a consistent effective weight on bit 30. As holdback valve 114 is moved from an open position to a closed position, the pressure of hydraulic fluid at pilot 118 increases. This increase in pressure at pilot 118 decreases the necessary pressure of the hydraulic fluid in second passage 130 to overcome the force of spring 116 and open counterbalance valve 112. Thus, as the weight of drill string 28 increases, holdback valve 114 moves to a more closed position, thereby increasing the hydraulic fluid at pilot 118 and reducing the necessary hydraulic fluid pressure in second passage 130 to overcome the force of spring 116, and open counterbalance valve 112, thereby draining hydraulic fluid from retract chamber 104. While spring 116 may be mechanically tuned by a user such that the force of spring 116 may change, the change in value of the force of the spring 116 is accounted for in the system when calibrating holdback valve 114, as discussed below.

Accordingly, increasing the weight of drill string 28 pulls down piston 42, thereby increasing the pressure of the hydraulic fluid in retract chamber 104. This increase in pressure in retract chamber 104 would require a different (e.g., a greater) fluid pressure in extend chamber 102 to provide the desired pressure on drill string 28 and maintain an effective weight on bit 30. Accordingly, applying the same hydraulic fluid pressure to extend chamber 102 will have a different effect on drill string 28 When the weight of drill string 28 is increased, holdback valve 114 is adjusted toward a more closed position, causing counterbalance valve 112 to open and drain hydraulic fluid from retract chamber 104. This causes an amount of hydraulic fluid in retract chamber 104 to decrease until the pressure of hydraulic fluid in passage 130 is less than the pressure exerted at pilot 118. The reduced volume of hydraulic fluid in retract chamber 104 provides a lower pressure, thereby ensuring that the same pressure applied to extend chamber 102 provides approximately the same effective weight on bit 30. To determine this adjustment, a calibration of holdback valve 114 must be performed to correlate the amount of current applied to holdback valve 114 to the pressure in retract chamber 104.

Figure 4:
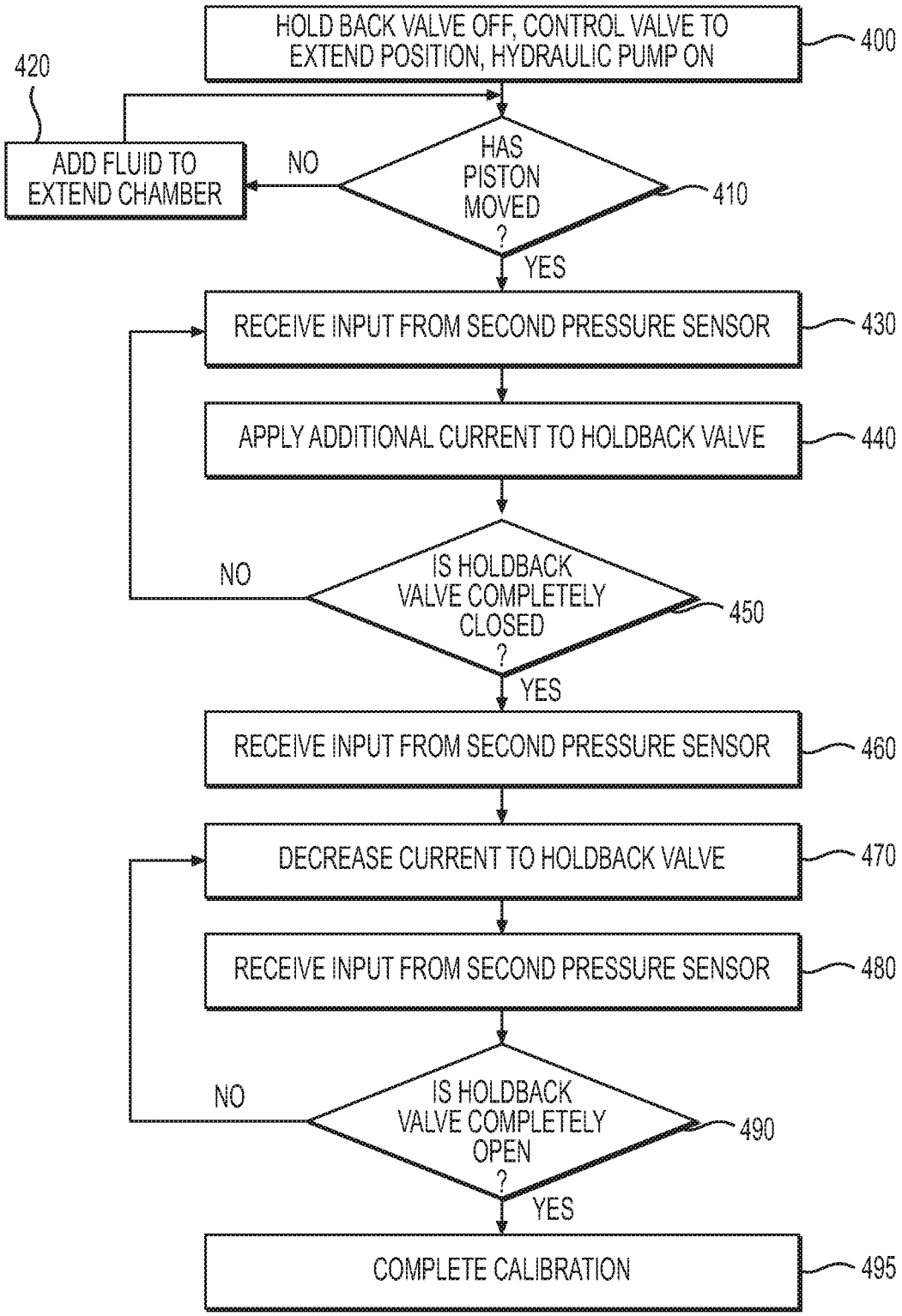
FIG. 4 provides a flowchart depicting an exemplary calibration of a holdback valve of the exemplary control system of FIGS. 1-3.

Referring to FIG. 4, a method of calibrating holdback valve 114 of a drilling machine will be described. In Step 400, controller 210 turns a current to holdback valve 114 "OFF", or 0 Amps, such that holdback valve 114 is in a fully open configuration. Also in Step 400, controller 210 controls control valve 126 to move to extend position 120 and controls hydraulic pump 37 to supply hydraulic fluid to extend chamber 102 (see FIG. 2). In Step 410, controller 210 determines if piston 42, including drill string 28 and drill bit 30, are moving in a downward direction (e.g., via position sensor 106). If piston 42 is not moving in a downward direction, controller 210 controls hydraulic pump 37 to continue to pump hydraulic fluid into extend chamber 102 in Step 420. If piston 42 has begun to move downward in Step 410, controller 210 receives second pressure sensor pressure 218 from second pressure sensor 110 associated with retract chamber 104, and controls hydraulic pump 37 to maintain a constant amount of hydraulic fluid in Step 430. In Step 440, controller 210 controls an amount of current to be applied to holdback valve 114, thereby closing holdback valve 114 a predetermined amount. In Step 450, it is determined if holdback valve 114 is completely closed, i.e., if the valve is saturated with current. If holdback valve 114 is not completely closed, Steps 430 and 440 are repeated until holdback valve 114 is completely closed. For example, current applied to holdback valve 114 is ramped up in a stepwise manner, thereby slowly closing holdback valve 114, and controller 210 receives second pressure sensor pressure 218 from second pressure sensor 110 at each current step. The number of current steps at holdback valve 114 from completely open to completely closed may be a predetermined number of steps, or may be set by a user. Once holdback valve 114 is completely closed, controller 210 receives second pressure sensor pressure 218 from second pressure sensor 110 associated with retract chamber 104, in Step 460. Subsequently, controller 210 controls a decrease in the amount of current to be applied to holdback valve 114 in Step 470, thereby opening holdback valve 114 a predetermined amount. In Step 480, controller 210 receives second pressure sensor pressure 218 from second pressure sensor 110 associated with retract chamber 104. In Step 490, it is determined if holdback valve 114 is completely open, i.e., if no current is applied to holdback valve 114. If holdback valve 114 is not completely open, Steps 470 and 480 are repeated until holdback valve 114 is completely open, at which point calibration is completed in Step 495.

Figure 5A:
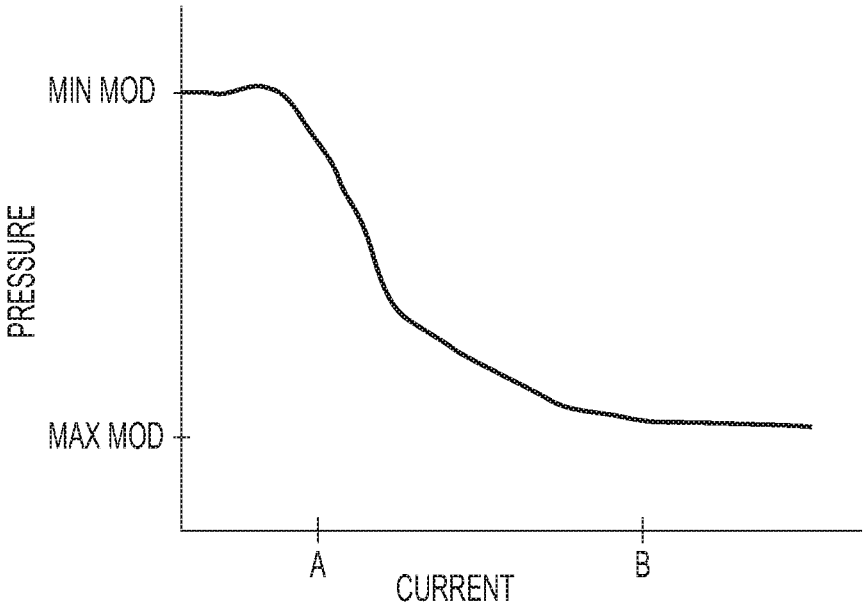
FIGS. 5A and 5B provide graphs of example results of the exemplary calibration of the holdback valve of FIG. 4.
Figure 5B:
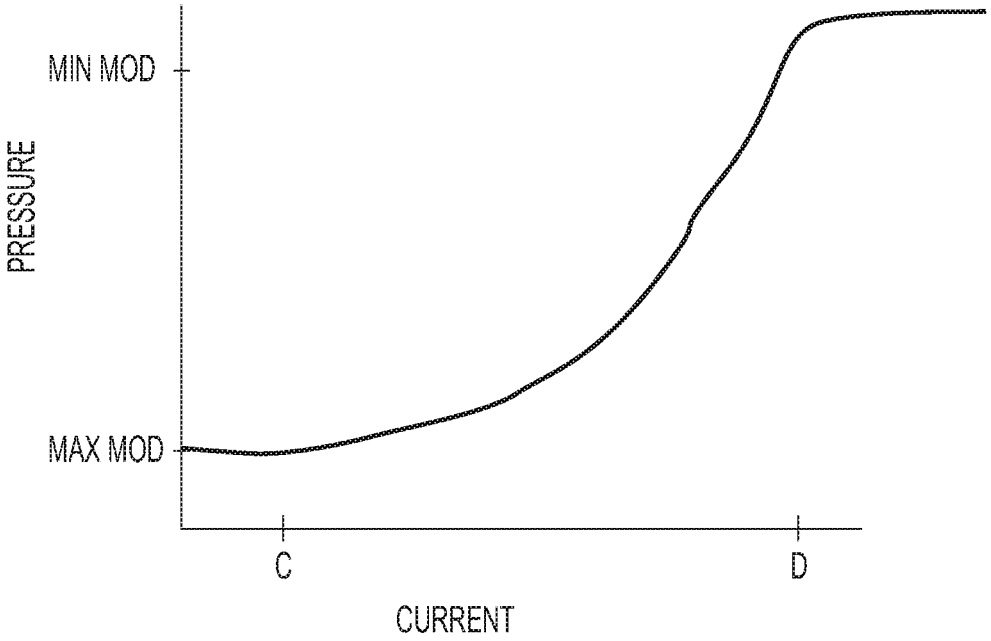

Upon completion of the steps discussed above, second pressure sensor pressure 218 associated with retract chamber 104, is plotted as a function of the current applied to holdback valve 114, as shown, for example, in FIGS. 5A and 5B. It will be understood that FIGS. 5A and 5B are solely used as examples, and the slope of the curves may be linear or non-linear. As shown in FIG. 5A, the current applied to holdback valve 114 is ramped up until second pressure sensor pressure 218 changes for a first time at current A, which is the minimum modulation value of holdback valve 114. Second pressure sensor pressure 218 continues to drop until a maximum modulation value at current B is reached, which is a measure of second pressure sensor pressure 218 when holdback valve is completely closed. As shown in FIG. 5B, the current applied to holdback valve 114 is ramped down until second pressure sensor pressure 218 changes for a first time at current C, which is the maximum modulation value of holdback valve 114. Second pressure sensor pressure 218 continues to increase until a minimum modulation value at current D is reached, which is a measure of second pressure sensor pressure 218 when holdback valve is completely open. These multiple graphs avoid hysteresis in the measurement values. The plots may be averaged together to get a single plot of current values applied to holdback valve 114 and associated pressures of retract chamber 104 (not shown).

As discussed above, pressures of hydraulic fluid in extend chamber 102 and retract chamber 104 are measured when holdback valve 114 is completely open and completely closed. From this data, controller 210 can determine a relationship (i.e., chart, table, or map, such as the chart shown in FIG. 5) between the pressure in retract chamber 104 and current applied to holdback valve 114. With this relationship, controller 210 can adjust the open position of holdback valve 114 so that a specific pressure of hydraulic fluid in extend chamber 102 moves piston 42 a known amount, thereby providing the same effective weight on bit 30, regardless of the weight of drill string 28. In this example, the relationship or calibration of holdback valve 114 based on the pressure in retract chamber 104 may be exponential, as shown for example in FIG. 5. It will be understood, however, that the relationship may be linear. Further, it will be understood that any number of test points may be obtained to provide a more accurate relationship or calibration values. For example, a map may include a plurality of additional pressure values associated with a position of holdback valve 114, such as a pressure value associated with holdback valve 114 being in a midpoint orientation.

Additionally, the calibration process can be supplemented by adding a known weight to drill string 28. In this manner, controller 210 may develop a relationship including the weight attached to the drill string 28, i.e., the known weight of the drill string 28, the pressure of retract chamber 104, and the position of the holdback valve 114.

Accordingly, a user may input the weight of drill string 28 and/or input the number of pipes in drill string 28, and controller 210 may send holdback valve command 230 to open or close variable holdback valve 114 to compensate for the weight of drill string 28 and ensure that the same pressure applied to of extend chamber 102 results in approximately same effective weight on drill bit 30, e.g. force at drill bit 30. Alternatively, or additionally, the control may be automatically performed by controller 210 based on the number of pipes and/or weight of drill string 28. Thus, such a control system 100 can assist in maintaining a consistent drilling process—e.g. maintain a desired drill string force regardless of the variability in weight of the drill string 28. This consistency in drill string forces is especially helpful in down-the-hole hammer type drill bits 30, whereas such drill bits may be sensitive to undesired variability drill string forces.

INDUSTRIAL APPLICABILITY

The disclosed aspects of mobile drilling machine control system 100 of the present disclosure may be used in any drilling machine including, but not limited to, a rotary type or down-the-hole type mobile drilling machine.

It will be apparent to those skilled in the art that various modifications and variations can be made to the disclosed system without departing from the scope of the disclosure. Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A control system for a drilling machine, comprising:
- a vertically movable and rotatable drill string having a drill bit at a distal end;
- a hydraulic cylinder coupled to the drill string to provide a motive force for the vertical movement of the drill string, the hydraulic cylinder having an extend chamber and a retract chamber;
- a counterbalance valve selectively opening to fluidly couple the retract chamber to a drain; and
- a holdback valve selectively controlled to adjust the opening of the counterbalance valve based on a weight of the drill string.

2. The control system according to claim 1, wherein holdback valve selectively controls the opening of the counterbalance valve by adjusting a pilot pressure applied to a valve element of the counterbalance valve.

3. The control system according to claim 1, wherein the drill string includes a down-the-hole hammer type drill bit.

4. The control system according to claim 1, further including a control valve controlling a supply of pressurized fluid to the hydraulic cylinder, and holdback valve is selectively controlled when the control valve is positioned to supply pressurized fluid to the extend chamber of the hydraulic cylinder.

5. The control system according to claim 4, wherein the pressurized fluid to the extend chamber also provides a pilot pressure to a valve element of the counterbalance valve, the pilot pressure being controlled by the holdback valve.

6. The control system according to claim 5, wherein the counterbalance valve is urged toward the open position by the pressure in the retract chamber of the hydraulic cylinder.

7. The control system according to claim 6, wherein a position of the holdback valve is adjustable between a fully open position and a full closed position to adjust the pilot pressure applied to the valve element of the counterbalance valve.

8. The control system according to claim 7, wherein the position of the holdback valve is controlled by a controller based on a relationship between a pressure in the retract chamber and a pressure in the extend chamber.

9. The control system according to claim 8, wherein a position of the holdback valve is adjusted so that a particular hydraulic pressure applied to the extend chamber provides approximately the same effective weight on the drill bit regardless of the weight of the drill string.

10. A control system for a drilling machine, comprising:
- a vertically movable and rotatable drill string having a drill bit at a distal end;
- a hydraulic cylinder coupled to the drill string to provide a motive force for the vertical movement of the drill string, the hydraulic cylinder having an extend chamber and a retract chamber;
- a counterbalance valve selectively opening to fluidly couple the retract chamber to a drain;
- a holdback valve selectively controlled to adjust a pilot force applied to the counterbalance valve, a position of the holdback valve being adjustable between a fully open position and a fully closed position; and
- a controller configured to:
  - receive a first set of inputs corresponding to a pressure of hydraulic fluid in the retract chamber,
  - receive a second set of inputs corresponding to a current applied to the holdback valve and corresponding to a position of the holdback valve; and
  - calibrate the holdback valve based at least on the first and second set of inputs, the calibration controlling the drilling machine so that a particular hydraulic pressure applied to the extend chamber provides approximately the same effective weight on the drill bit regardless of the weight of the drill string.

11. The control system of claim 10, wherein the calibration is further based on a movement of the drill string.

12. The control system of claim 11, wherein the calibration is further based on a weight of the drill string.

13. The control system of claim 12, wherein the controller is further configured to adjust the position of the holdback valve based on the calibration.

14. The control system of claim 13, wherein the adjusting of the position of the holdback valve occurs when pressurized fluid is being supplied to the extend chamber.

15. The control system of claim 14, wherein the drilling machine is a mobile drilling machine, and the drill string includes a down-the-hole type drill bit.

16. A method of controlling a drilling machine, the drilling machine including a vertically movable and rotatable drill string having a drill bit at a distal end; a hydraulic cylinder coupled to the drill string to provide a motive force for the vertical movement of the drill string, the hydraulic cylinder having an extend chamber and a retract chamber; a counterbalance valve selectively opening to fluidly couple the retract chamber to a drain; a holdback valve selectively controlled to adjust a pilot force applied to the counterbalance valve, a position of the holdback valve being adjustable between a fully open position and a fully closed position; and a controller, the method comprising:
- receiving at the controller, a first set of inputs corresponding to a pressure of hydraulic fluid in the retract chamber;
- receiving at the controller a second set of inputs corresponding to a current applied to the holdback valve and corresponding to a position of the holdback valve;
- calibrating the holdback valve based at least on the first and second set of inputs; and
- controlling the drilling machine based on the calibration so that a particular hydraulic pressure applied to the extend chamber provides approximately the same effective weight on the drill bit regardless of the weight of the drill string.

17. The method of claim 16, wherein the calibration is also based on a movement of the drill string.

18. The method of claim 17, wherein the calibration is also based on a weight of the drill string.

19. The method of claim 18, further comprising controlling the position of the holdback valve based on the calibration.

20. The method of claim 19, further comprising adjusting the position of the holdback valve when pressurized fluid is being supplied to the extend chamber.

* * * * *